US006540095B2

(12) United States Patent
Haringer

(10) Patent No.: US 6,540,095 B2
(45) Date of Patent: Apr. 1, 2003

(54) PIPE-LAYING VEHICLE

(75) Inventor: Alois Johann Haringer, Neumarkt (IT)

(73) Assignee: macmoter S.p.A., Modigliana (IT)

( * ) Notice: Subject to any disclaimer, the term of this patent is extended or adjusted under 35 U.S.C. 154(b) by 0 days.

(21) Appl. No.: 09/765,237

(22) Filed: Jan. 16, 2001

(65) Prior Publication Data

US 2001/0009241 A1 Jul. 26, 2001

(30) Foreign Application Priority Data

Jan. 25, 2000 (DE) ..... 100 03 058
May 15, 2000 (EP) ..... 00110185

(51) Int. Cl.[7] ..... B66C 1/00; B66D 3/08; B66D 3/10

(52) U.S. Cl. ..... 212/242; 212/197; 212/251; 212/259; 212/347

(58) Field of Search ..... 212/196, 197, 212/198, 347, 232, 242, 251, 259; 414/563; 254/415

(56) References Cited

U.S. PATENT DOCUMENTS 2,321,549 A * 6/1943 Holmes ..... 254/415 X
2,541,970 A * 2/1951 Pospisil ..... 414/563 X
2,650,066 A * 8/1953 Troyer ..... 254/415
3,006,608 A * 10/1961 Cimino ..... 254/415
3,435,961 A * 4/1969 Hamson ..... 212/197
4,343,458 A * 8/1982 Simon ..... 254/415 X

* cited by examiner

*Primary Examiner*—Steven A. Bratlie
(74) *Attorney, Agent, or Firm*—W. F. Fasse; W. G. Fasse

(57) ABSTRACT

The pipe-laying vehicle 1 includes a lower vehicle body 2, a driver's cab, and a jib 10 which is supported on the lower vehicle body 2, can be raised and lowered about a horizontal axis 11, and can be swivelled about a vertical pivot axis by a live ring. On the outer end of the jib 10, a sheave head 31 is provided with a deflection pulley 26 and a sheave 28, and can be swivelled as a whole relative to the jib 10 about an adjustment axis 32 that extends in the longitudinal direction of the jib 10. A mechanically or hydraulically actuated locking device selectively locks the pivot position of the sheave head 31 relative to the jib 10. As a result of the swivel capability of the jib 10 and of the sheave head 31, the pipe laying work can be performed more simply and quickly.

12 Claims, 9 Drawing Sheets

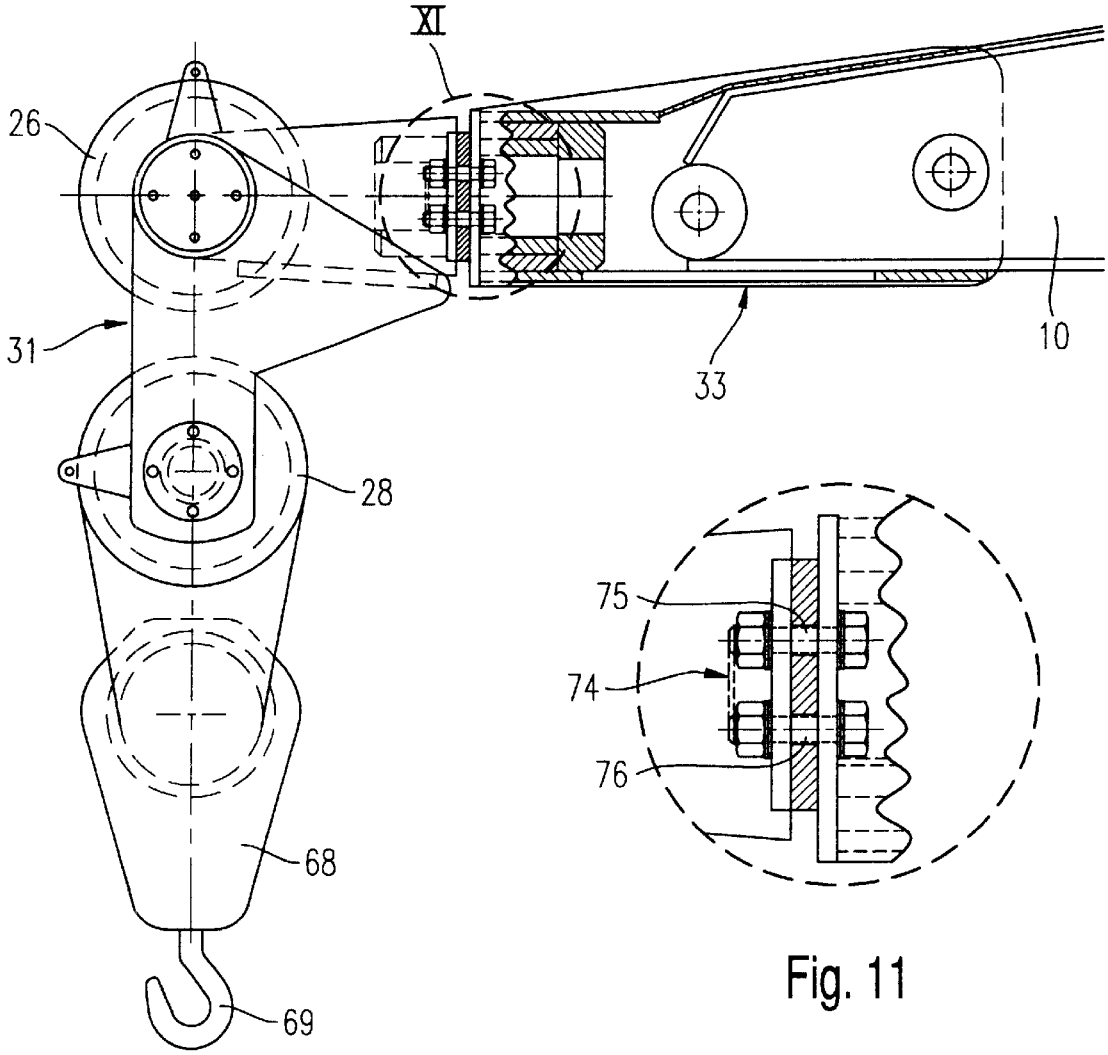
Fig. 10
Fig. 11
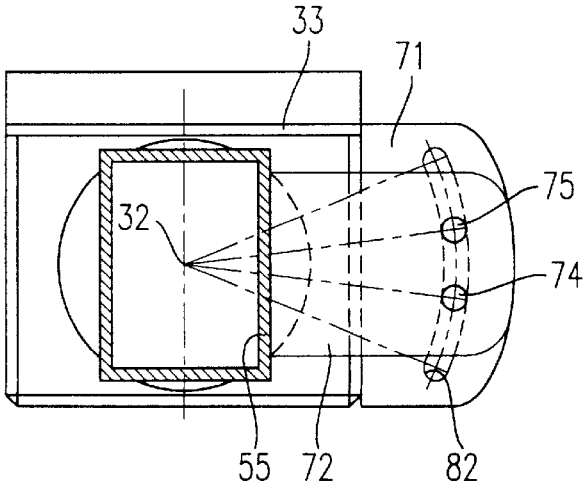
Fig. 12

PIPE-LAYING VEHICLE

FIELD OF THE INVENTION

The invention relates to a pipe-laying vehicle having a lower vehicle body, a driver's cab or driver's stand, a jib, which possesses at its outer end a sheave head with a sheave, and having drive mechanisms for movement, for raising and lowering the jib and for winding up and unwinding the supporting cable running over the sheave.

BACKGROUND INFORMATION

Such a pipe-laying vehicle, which is used in the constriction of pipe lines laid below the surface of the earth, is known. In such vehicles, the jib, articulated on the lower vehicle body by means of a horizontal axle, can be displaced only within a vertical plane which is determined by the vehicle. The alignment of the pipes, supported essentially horizontally by the jib, is performed by appropriate manoeuvring of the lower vehicle body. The sheave head, in which a deflection pulley for the supporting cable and the upper sheave of a block and tackle are mounted, is fixedly connected by welding to the outer end of the jib. A consequence of this rigid connection of the sheave head to the jib is that the sheave head and the two sheaves mounted therein are always situated in the vertical plane in which the more or less steeply inclined jib also extends. In order, when suspending the load, to orient the sheave head towards the pipe to be suspended and, moreover, to set down the pipe in the intended position of installation, it is therefore necessary for the jib to be brought into an appropriately oriented position by manoeuvring the pipe-laying vehicle. This working procedure, in which the pipe-laying vehicle also has to be moved and manoeuvred when the pipe to be laid is to be turned only through a small angle relative to the ground or is not located approximately vertically below the sheave head, is elaborate and time-consuming.

SUMMARY OF THE INVENTION

Accordingly, the object of the invention is to design the pipe-laying vehicle in such a way that it is better adapted to the requirements to be met and permits simpler and more rapid working.

This object is achieved, according to the invention, in that the jib can be swivelled by means of a swivel drive relative to the lower vehicle body about a pivot axis standing perpendicular to the lower vehicle body and in that the sheave head is mounted to swivel on the jib about an adjustment axis.

The swivelling according to the invention of the jib about a vertical axis, which is expediently achieved by supporting the jib on the lower vehicle body via a live ring, offers the possibility, with the vehicle stationary and, if appropriate, stabilized, of laying pipes within a circumference determined by the range of the inclinable jib and aligning them with a pipe trench—which is done by the interplay of swivel movements and changes of inclination of the jib and winding up or unwinding the supporting cable. The swivelling of the sheave head relative to the jib allows limited swivelling of the sheave head to left or right, out of the vertical plane of the jib, in order to set the sheave head for a load located off to one side on the ground, so that this load can easily be suspended from the jib and pulled across the ground to the vertical plane of the jib. The automatic.setting of the swivelling sheave head for the load to be suspended, or its position, also has the particular advantage that the supporting cable extends from the sheave head towards the load in a direction which deviates to a lesser extent, if at all, from the sheave plane. As a result, the friction between the supporting cable and the sheaves is reduced and smooth running of the cable over the sheaves is enhanced, without any cause for fear that the cable may jump out of the circumferential grooves of the sheaves. When the lifted pipe is set down, also, this can be more simply and reliably controlled under the action of transverse forces, enabling it to be set down wholly or partially outside the plane of the jib. Accordingly, the swivelling of the sheave head relative to the jib also simplifies the work of pipe laying.

However, the swivelling of the sheave head is not always desirable. Consequently, a further development envisages assigning to the sheave head a locking device which permits the fixing of the sheave head in its central position or in a position swivelled out of this central position to one side or the other.

This locking device may be so designed that it simultaneously restricts the swivelling of the sheave head to a particular angular range. The actuation of the locking device may be mechanical, hydraulic or pneumatic. The hydraulic blocking and releasing of the locking device suggests itself if a hydraulic device is already present to actuate the jib of the pipe-laying vehicle, particularly since convenient remote actuation of the locking device can also be achieved in this manner.

BRIEF DESCRIPTION OF THE DRAWINGS

Example embodiments of the invention will be described below in detail with reference to the accompanying diagrammatic drawings, in which:

FIG. 10 shows a lateral view of the arrangement according to FIG. 8;

FIG. 11 shows the detail XI in FIG. 10 on an enlarged scale;

FIG. 12 shows an enlarged sectional view along the line XII—XII in FIG. 8;

DETAILED DESCRIPTION OF PREFERRED EXAMPLE EMBODIMENTS OF THE INVENTION

Figure 1:
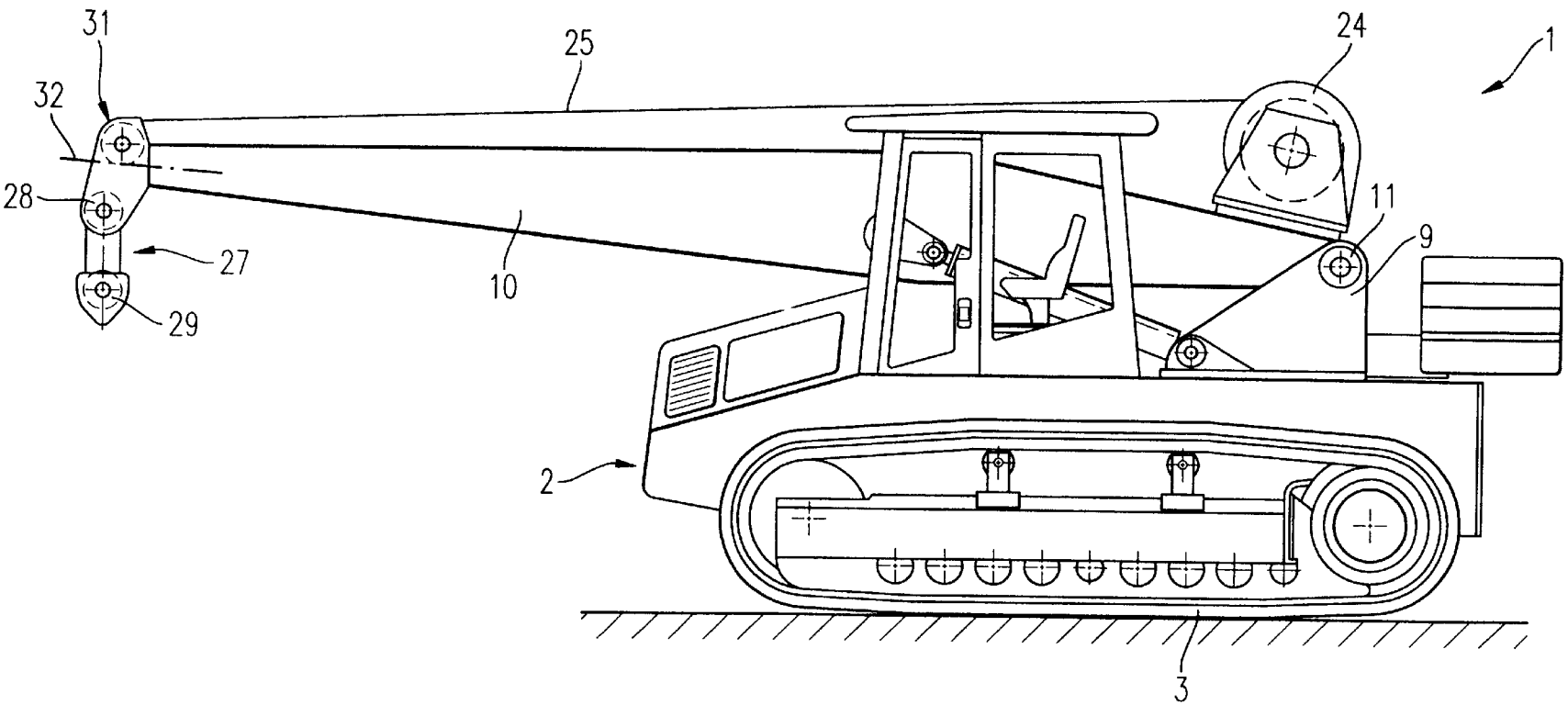
FIG. 1 shows a lateral view of a pipe-laying vehicle with the jib lowered in the position of rest or transport position.

The pipe-laying vehicle 1 according to FIGS. 1 to 4 shows a lower vehicle body 2, designed as a tracked vehicle having lateral drive chains 3 and 4, and possessing a driver's cab 5 which is arranged at a distance to the left of the longitudinal median plane 6 of the lower vehicle body 2.

A live ring 7 having a vertical pivot axis 8 is arranged centrally behind the driver's cab 5 on the lower vehicle body 2 and supports a superstructure. The live ring 7 or the superstructure can be swivelled by means of a pivot drive (not shown) and comprises a jib base 9, on which a jib 10 is articulated with a horizontal axis of inclination 11. In order to raise and lower the jib, two parallel hydraulic units 12 and 13 are provided, each having a cylinder 14 and a piston rod 15, which are articulated on the jib base 9 or on the jib 10 with axes 16 and 17 parallel to the axis of inclination 11.

Connected to the jib base 9 by means of two horizontal telescopic guides 18 and 19 which extend approximately radially to the pivot axis 8 and in a diametrically opposite direction to the jib 10 is a counterweight 20, whose distance from the pivot axis 8 can be set by means of an adjustment device 21. The adjustment device 21 is likewise hydraulically actuated and possesses a cylinder 22 and a piston rod 23 that extend centrally between the two telescopic guides 18 and 19.

At its inner, articulated end, the jib 10 bears a winding drum 24, which can be reversibly driven by means of a drive mechanism (not shown), for a supporting cable 25 which is connected via a deflection pulley 26 at the free end of the jib 10 to a block and tackle 27 having an upper sheave 28. The moveable (lower) sheave arrangement 29 of the block and tackle 27 is connected to a suspension apparatus 30 for pipes, indicated only as a cable section. The deflection pulley 26 and the sheave 28 are mounted in a sheave head 31, which in turn is mounted at the outer end of the jib 10 to swivel about an adjustment axis 32.

Figure 2:
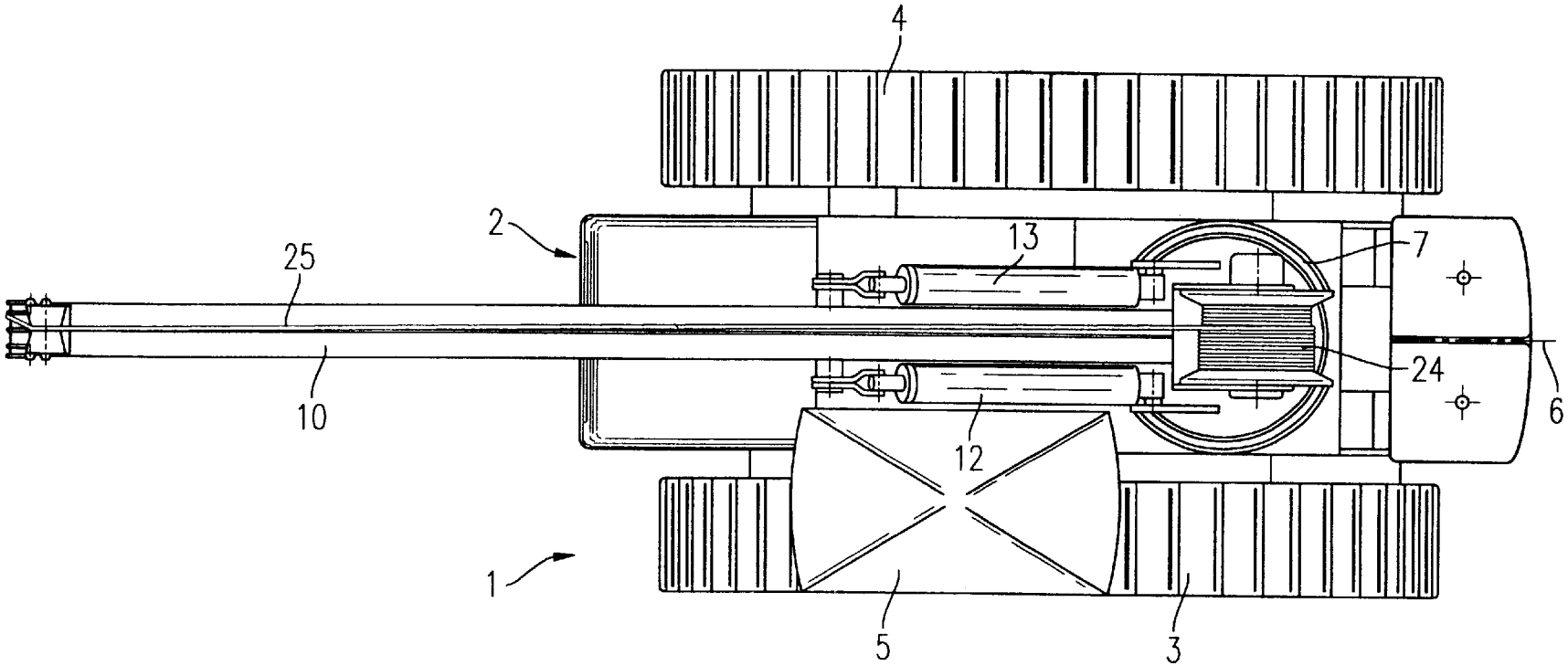
FIG. 2 shows a plan view of the pipe-laying vehicle according to FIG. 1.

FIGS. 1 and 2 show the jib 10 with the hydraulic units 12 and 13 retracted and the adjustment device 21 retracted in its position of rest, in which the jib 10 extends approximately horizontally forwards in the longitudinal median plane 6. This position of rest is also the position in which the pipe-laying vehicle 1 is transported to its place of use and back.

Figure 3:
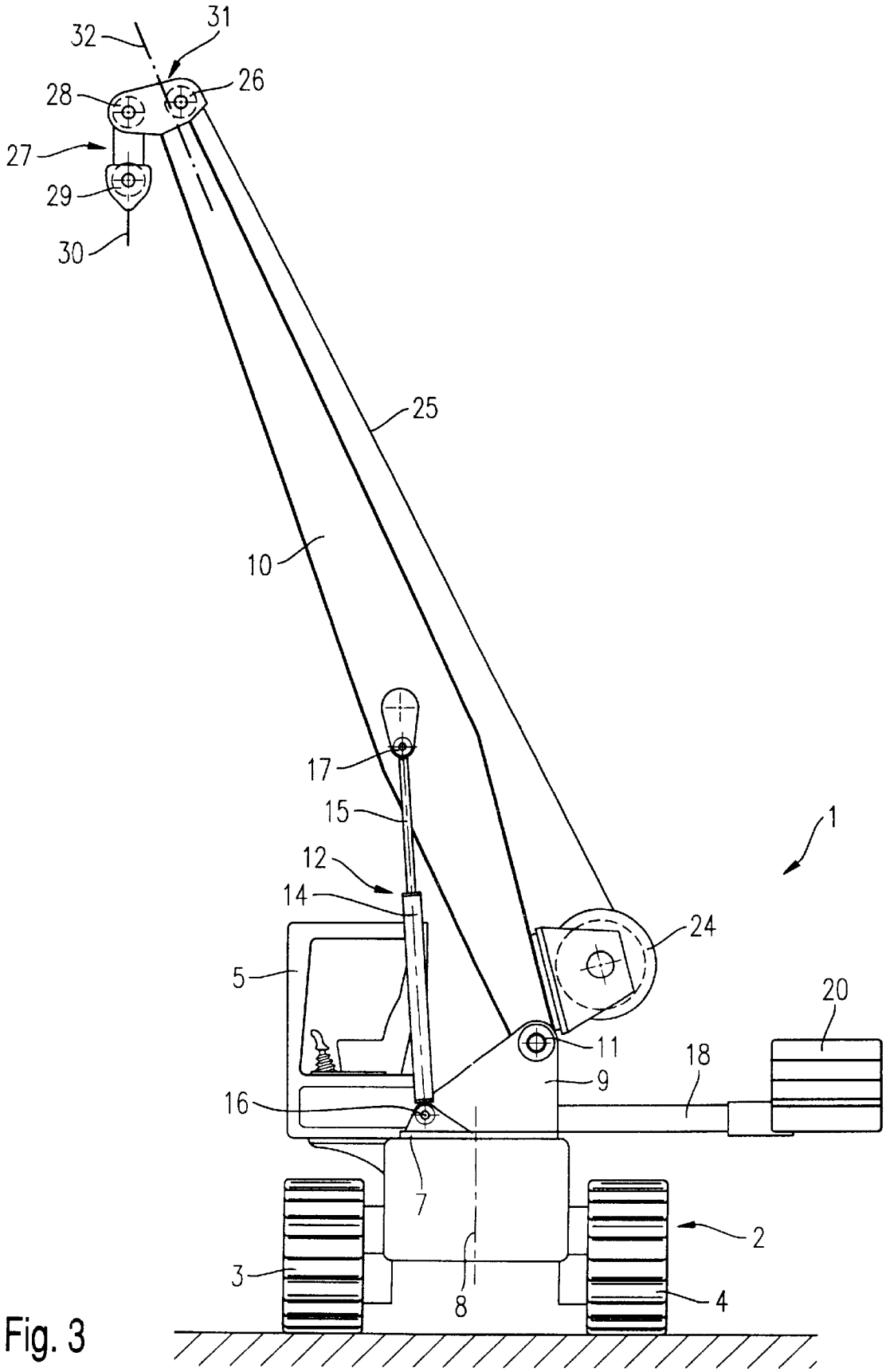
FIG. 3 shows an end-on view of the pipe-laying vehicle with the jib raised and swivelled into a working position.
Figure 4:
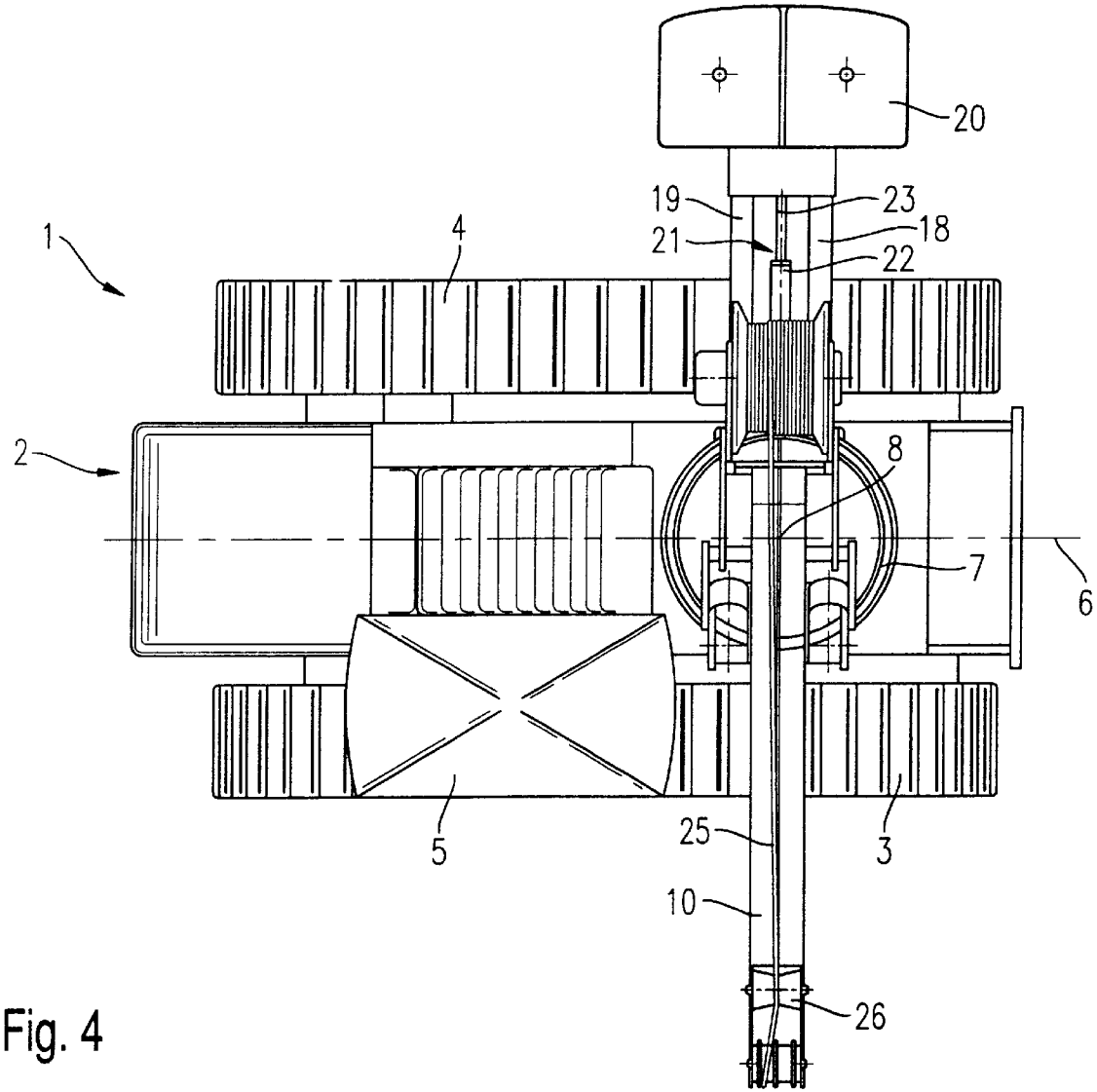
FIG. 4 shows a plan view of the pipe-laying vehicle shown in FIG. 3.

As FIG. 3 shows, the jib 10 can be raised into an upright position in which it can be pivoted about the pivot axis 8, over the driver's cab 5, into a working position. The counterweight 20, which according to FIGS. 3 and 4 has been moved out to a greater distance from the pivot axis 8, would however collide with the driver's cab 5 in the event of appropriate further pivoting. Accordingly, the pivot range of the jib 10 is limited. This limitation is less if the jib 10, in the raised position, can be pivoted away over the driver's cab 5, and can be avoided altogether if the driver's cab is also supported on the live ring (not shown) and is thus swivelled together with the jib 10. Swivelling through at least 270° about the pivot axis 8 is desirable.

Figure 5:
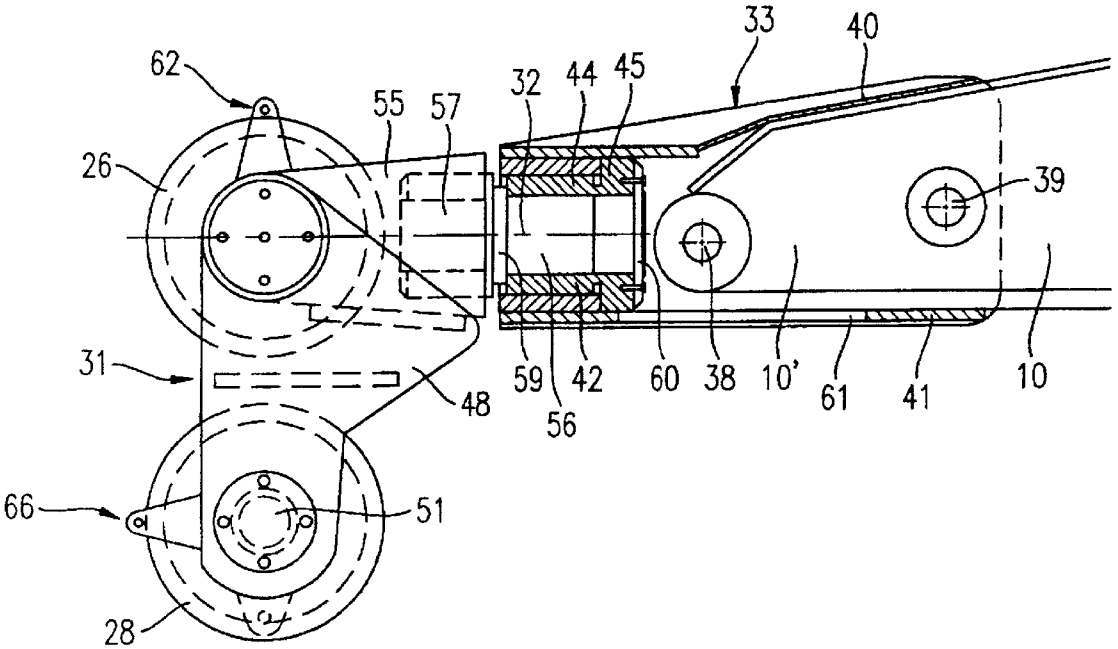
FIG. 5 shows the sheave head and the outer end of the jib, pivoted down into the horizontal position, in a partially sectioned lateral view.
Figure 6:
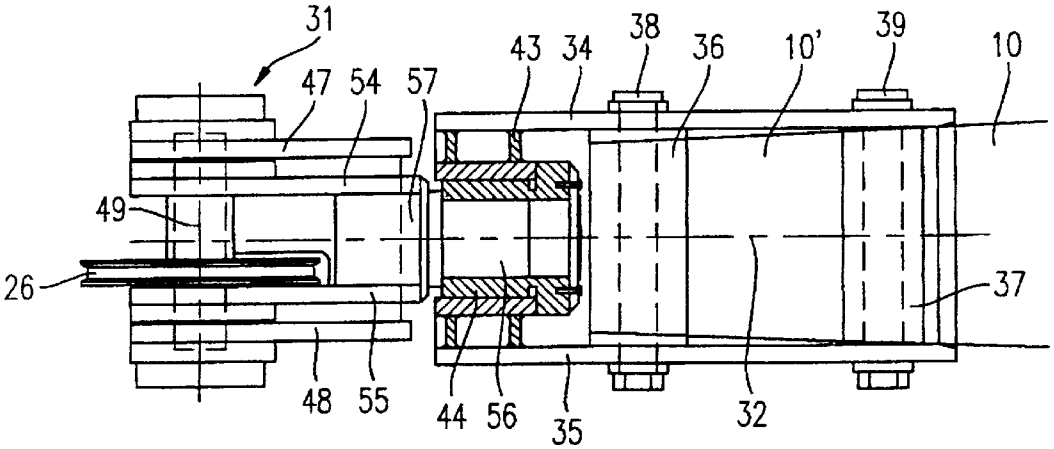
FIG. 6 shows the arrangement according to FIG. 5 in a partially sectioned plan view.
Figure 7:
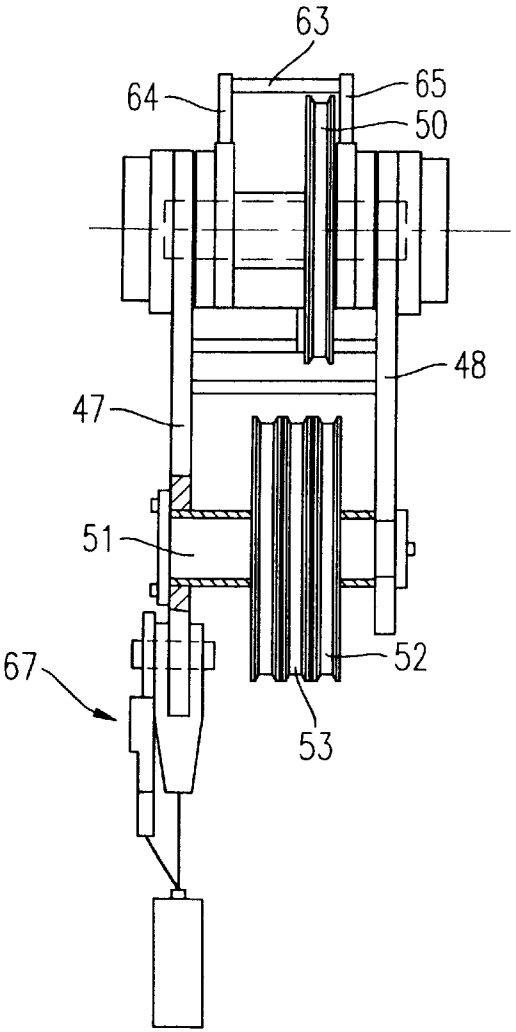
FIG. 7 shows the arrangement according to FIG. 5 in a partially sectioned end-on view from the left.
Figure 13:
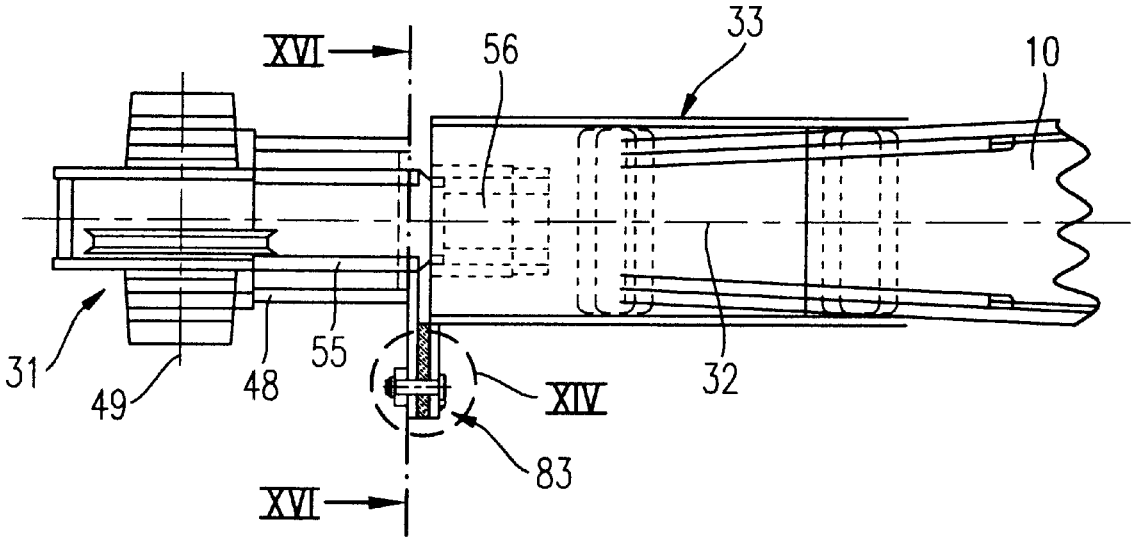
FIG. 13 shows a view corresponding to FIG. 8 but with a hydraulically actuated locking device.
Figure 14:
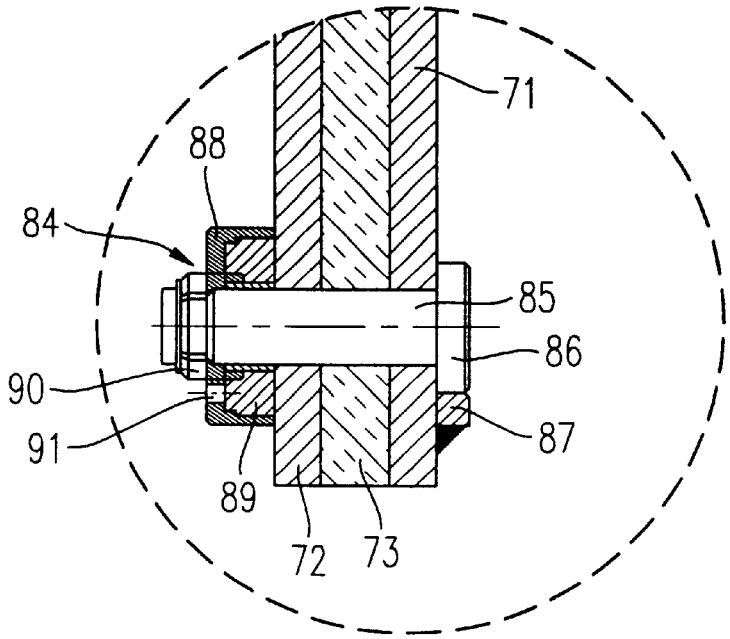
FIG. 14 shows the detail XIV in FIG. 13 on an enlarged scale.
Figure 15:
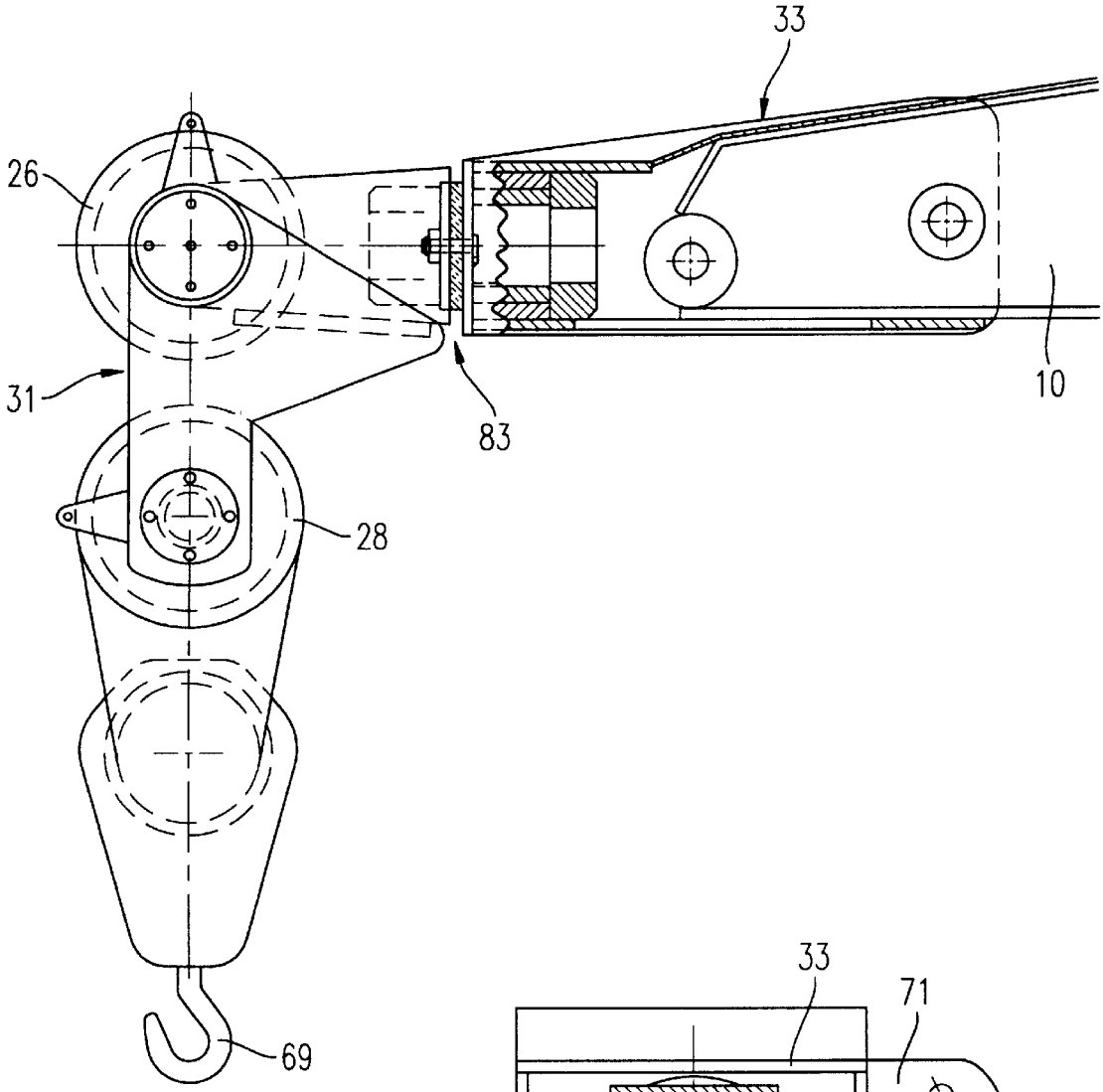
FIG. 15 shows a lateral view of the arrangement according to FIG. 13.
Figure 16:
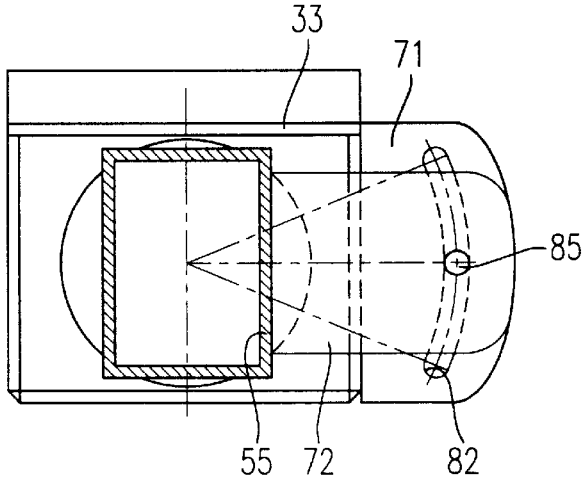
FIG. 16 shows a section along the line XVI—XVI in FIG. 13 on an enlarged scale.

According to FIGS. 5 and 7, an intermediate piece 33 is connected to the outer end 10' of the jib 10 and possesses two parallel bearing plates 34 and 35 which are fixed in their respective positions by two spacer sleeves 36 and 37 and by securing bolts 38 and 39 extending through the latter. The intermediate piece 33 also has contact plates 40 and 41 between the bearing plates 34 and 35 whose shape and size are adapted to the outer end of the jib 10, so that the box-shaped intermediate piece 33 can be pushed onto the outer end of the jib 10, as can be seen in FIG. 5, and can be fixedly clamped thereto by means of the securing bolts 38, 39, as can be seen from FIG. 6.

A bearing cylinder 42 is inserted into the end of the intermediate piece 33 remote from the jib 10 and is welded to the contact plates 40 and 41 directly and to the bearing plates 34 and 35 via a plurality of radial struts 43. A bearing bush 44 consisting of a slip material having a low coefficient of friction is inserted into the bearing cylinder 42 and possesses a radial flange 45 engaging onto the bearing cylinder 42 at the end face.

The bearing bush 44 serves for the swivelling mounting of the sheave head 31, which possesses two parallel bearing plates 47, 48, between which are mounted the deflection pulley 26, on an axle 49, and the sheave 28 with-a number of circumferential grooves 53 on an axle 51. The supporting cable 25, not shown in FIGS. 5 to 7, passes from the sheave 28 over the single-grooved deflection pulley 26 and onwards along the jib 10—at a short distance above the jib 10 in the illustration according to FIG. 5—to the winding drum 24 near the inner end of the jib 10.

The axle 49 of the deflection pulley 26 is mounted in two parallel securing plates 54, 55, so that the sheave 28 and its axle 51 can pivot about the axle 49 of the deflection pulley 26. Without the action of external forces, the sheave 28 hangs vertically below the deflection pulley 26 under the action of gravity, as shown by FIG. 5.

The two securing plates 54, 55 are connected to a bearing journal 56, which possesses an enlarged journal head 57 provided with flattened circumferential portions, the journal head 57 being arranged between the two securing plates 54, 55 and fixedly welded thereto. The bearing journal 56 is mounted in the bearing bush 44 so that the entire sheave head 31 can be swivelled about the adjustment axis 32. This extends in the longitudinal direction of the jib 10.

For the axial securing of the bearing journal 56 in the bearing bush 44, the bearing journal 56 possesses a journal collar 59 at the transition to the journal head 57, engaging over one end face of the bearing bush 44. Furthermore, a stop part 60 is connected to the bearing journal 56, for example by means of a screw, and engages over the other end face of the bearing bush 44. The screw and the stop part 60 are accessible via a recess 61 in the contact plate 41. The distance between the stop part 60 and the journal collar 59 guarantees an adequate axial bearing play of the bearing journal 56.

Assigned to the deflection pulley 26 is a cable depressor 62, which according to FIG. 7 is formed by two radially projecting securing tabs 64, 65 and a retaining rod 63 extending between them. A corresponding cable depressor 66 is assigned to the sheave 28 with the circumferential grooves 53.

As shown in FIG. 7, a depending actuating device 67 is connected to the bearing plate 47 of the sheave head 31 and enables the sheave head 31 to be swivelled by hand, to a limited extent, about the adjustment axis 32. In the same manner, the sheave 28 can also be swivelled to a limited extent about the axle 49 and thereby moved out of a position vertically below the deflection pulley 26.

Figure 8:
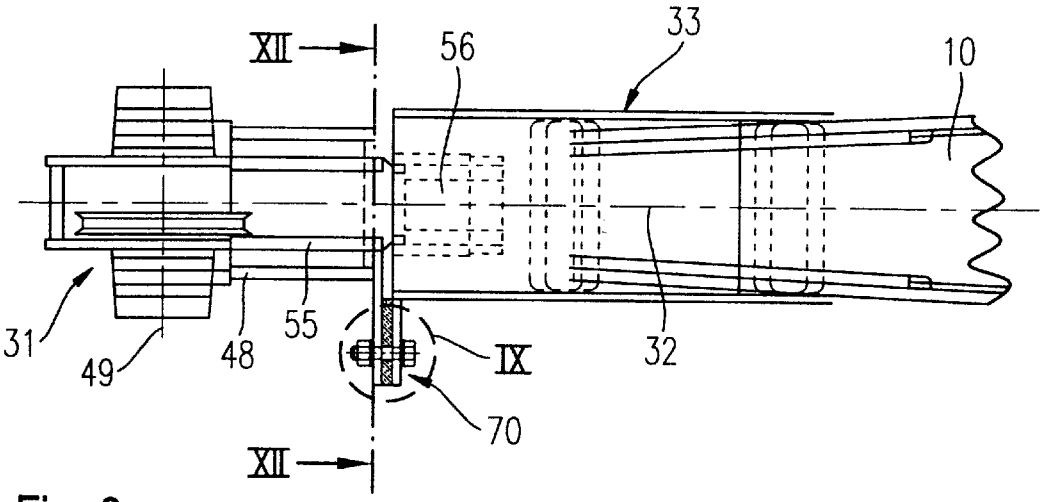
FIG. 8 shows a plan view of an arrangement corresponding to FIGS. 5 to 7, additionally provided with a mechanical locking device.

FIGS. 8 and 10 show the arrangement of a sheave head 31 on the jib 10 with the use of an intermediate piece 33, this arrangement largely coinciding with the arrangement described, in accordance with FIGS. 5 to 7, so that the same reference numerals are provided for corresponding parts. FIG. 10 also shows the suspended carrier piece 68 with the load hook 69.

The essential difference in the embodiment according to FIGS. 5 to 7 resides in the fact that, in addition, a mechanical locking device 70 is provided, with the aid of which the respective pivot position of the sheave head 31, and especially its median position relative to the jib 10, can be fixed.

This locking device 70 includes a locking plate 71, which is fixedly welded to the intermediate piece 33 and projects laterally on one side from this intermediate piece 33, and a pivot plate 72 which is fixedly connected to the sheave head 31 or to the bearing plate 48 and securing plate 55 and similarly projects laterally on one side. As particularly shown in the enlarged FIGS. 9, 11 and 12, the two plates 71 and 72 extend parallel to one another and enclose between them a plate-shaped intermediate layer 73 which consists of a friction material.

Figure 9:
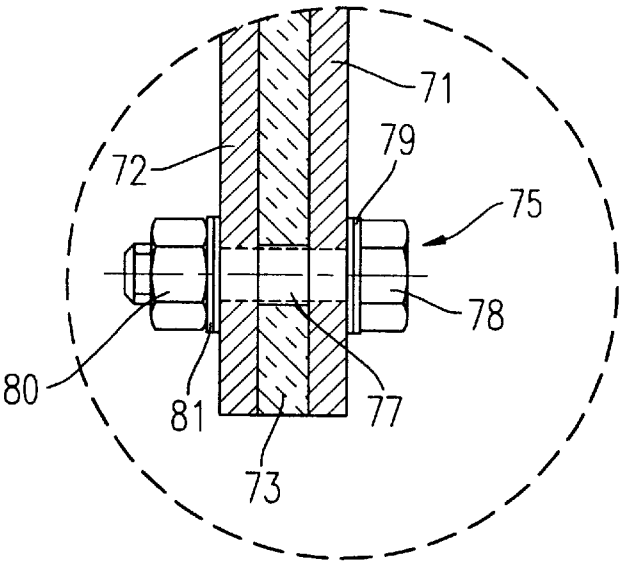
FIG. 9 shows detail IX in FIG. 8 on an enlarged scale.

A clamping device 74 includes two clamping bolts 75 and 76, which extend through the two plates 71, 72 and the intermediate layer 73 and are each formed by a clamping screw 77 which, according to FIG. 9, is supported by its head 78 via a spring ring 79 on the outside of the locking plate 71. Screwed onto the clamping screw 77 is a clamping nut 80 which rests, via a spring ring 81, on the outside of the pivot plate 72. By tightening the two clamping nuts 80, the two plates 71 and 72 can be clamped together in a manner tightly fixed against rotation relative to each other, as a result of which the ability of the sheave head 31 to swivel about the adjustment axis 32 is eliminated until the two clamping nuts are released.

The clamping bolts 75 and 76 extend with only slight play through drilled holes in the pivot plate 72 and in the intermediate layer 73. By contrast, the locking plate 71, as can be seen in FIG. 12, possesses a slit 82 to receive the clamping bolts 75 and 76, extending in an arcuate manner about the adjustment axis 32 of the sheave head 31. This slit 82 makes it possible, with the clamping nuts 80 released, to swivel the pivot plate 72 relative to the locking plate 71 and hence the sheave head 31 relative to the jib 10. The length of the slit 82 here restricts the pivot range, since its ends interact as a stop with the clamping bolts 75 and 76. This pivot range should be at least 45°.

The design according to FIGS. 13 to 16 largely corresponds to that according to FIGS. 8 and 12, but a hydraulically actuated locking device 83 is provided instead of the mechanically actuated locking device 70. This largely coincides with the locking device 70, and accordingly, in FIGS. 14 and 16, the same reference numerals are provided for the locking plate 71, the pivot plate 72, the intermediate layer 73 and the slit 82 in the locking plate 71.

The clamping device 84 is of different design. It possesses only a single clamping bolt 85, which bears with its head 86 directly on the locking plate 71 and rests on a carrier piece 87 welded onto the locking plate 71.

Placed on the end of the clamping bolt 85 remote from the head 86 is an annular clamping cylinder 88 of approximately U-shaped cross section, open towards the pivot plate 72, which receives a correspondingly annular pressure piston 89 and is secured on the clamping bolt 85 by a nut 90 screwed onto the bolt end and fixed. This nut 90 is not a clamping nut like the clamping nut 80 according to FIG. 9 but forms an abutment for the clamping cylinder 88.

The clamping cylinder 88 is provided at its end face with a connector 91 for a hydraulic line (not shown). If hydraulic fluid is supplied via this line, the clamping cylinder 88 is supported on the nut 90 and the pressure piston 89 is extended so that the plates 71 and 72 are pressed against the intermediate layer 73 and thereby clamped together in a manner tightly fixed against rotation.

What is claimed is:

1. A pipe-laying vehicle comprising:

a lower vehicle body defining a major vehicle body plane extending along said vehicle body;

a driver's cab mounted on said lower vehicle body;

a jib having a base end and a free end opposite each other, wherein said base end is pivotally connected to said lower vehicle body so that said jib is pivotable relative to said lower vehicle body about a first pivot axis (8) oriented perpendicularly relative to said major vehicle body plane and about a second pivot axis (11) oriented parallel to said major vehicle body plane;

a sheave head pivotally mounted on said free end of said jib so that said sheave head is pivotable relative to said jib about an adjustment axis (32) that extends longitudinally along a longitudinal extension direction of said jib passing through said base end and said free end, and wherein said sheave head comprises two parallel spaced-apart bearing plates, a deflection pulley rotatably arranged between said bearing plates, and an upper block sheave rotatably arranged between said bearing plates and spaced apart from said deflection pulley;

a lower block sheave arranged below said upper block sheave, and a pipe suspension device that is adapted to support therefrom a pipe to be laid by said pipe-laying vehicle, and that is connected to said lower block sheave; and a hoist cable running along said jib and deflecting over said deflection pulley, said upper block sheave, and said lower block sheave, so that said hoist cable, said upper block sheave and said lower block sheave together form a block and tackle arrangement for supporting, lifting and lowering the pipe to be laid from said pipe suspension device.

2. The pipe-laying vehicle according to claim 1, further comprising a live ring interposed between said jib and said lower vehicle body, wherein said live ring is pivotally driven about said first pivot axis so as to selectively pivot said jib about said first pivot axis relative to said lower vehicle body.

3. The pipe-laying vehicle according to claim 2, further comprising at least one hydraulic cylinder unit connected to said jib and to said live ring so as to selectively pivot said jib about said second pivot axis relative to said lower vehicle body.

4. The pipe-laying vehicle according to claim 1, further comprising a counterweight movably arranged opposite said jib about said first pivot axis, and an adjustment device connected to said counterweight and adapted to move said counterweight relative to said lower vehicle body so as to selectively adjust a distance between said counterweight and said first pivot axis.

5. The pipe-laying vehicle according to claim 1, further comprising a pivot bearing that pivotally connects said sheave head with said free end of said jib, wherein said pivot bearing comprises a bearing bush that is connected to said free end of said jib, a bearing journal that is connected to said sheave head and that is pivotally received in said bearing bush, a journal collar protruding from a first end of said bearing journal outwardly over a first end face of said bearing bush, and a stop member connected to and protruding from a second end of said bearing journal outwardly over a second end face of said bearing bush.

6. The pipe-laying vehicle according to claim 1, further comprising a locking device interposed and connected between said sheave head and said free end of said jib so as to selectively fix a particular selected pivot position of said sheave head relative to said jib about said adjustment axis.

7. The pipe-laying vehicle according to claim 6, wherein said locking device comprises a locking plate connected to and projecting laterally from said free end of said jib perpendicularly to said adjustment axis, a pivot plate connected to and projecting laterally from said sheave head perpendicularly to said adjustment axis and parallel to and spaced apart from said locking plate, a layer of a friction material received between said locking plate and said pivot plate, and a mechanical clamping device that selectively clamps together said locking plate and said pivot plate with said layer of said friction material therebetween in a clamping direction parallel to said adjustment axis so as to selectively mechanically frictionally fix said pivot plate to said locking plate and therewith selectively mechanically frictionally fix said sheave head to said free end of said jib so as to selectively prevent pivoting of said sheave head relative to said free end of said jib about said adjustment axis.

8. The pipe-laying vehicle according to claim 7, wherein said mechanical clamping device comprises a clamping bolt extending parallel to said adjustment axis through a fitting hole with play in one of said locking plate and said pivot plate and through an arcuate elongated slot in another of said locking plate and said pivot plate.

9. The pipe-laying vehicle according to claim 1, wherein said jib is pivotable through an angular range of at least 270° relative to said lower vehicle body about said first pivot axis, and said sheave head is pivotable through an angular range of at least 45° relative to said jib about said adjustment axis.

10. A pipe-laying vehicle comprising:

a lower vehicle body defining a major vehicle body plane extending along said vehicle body;

a driver's cab mounted on said lower vehicle body;

a jib having a base end and a free end opposite each other, wherein said base end is pivotally connected to said lower vehicle body so that said jib is pivotable relative to said lower vehicle body about a first pivot axis (8) oriented perpendicularly relative to said major vehicle body plane and about a second pivot axis (11) oriented parallel to said major vehicle body plane;

a sheave head pivotally mounted on said free end of said jib so that said sheave head is pivotable relative to said jib about an adjustment axis (32) that extends longitudinally along a longitudinal extension direction of said jib passing through said base end and said free end, and wherein said sheave head comprises two parallel spaced-apart bearing plates, and at least a deflection pulley rotatably arranged between said bearing plates;

a hoist cable running along said jib and deflecting over said deflection pulley, for supporting, lifting and lowering the pipe to be laid by said pipe-laying vehicle; and a locking device interposed and connected between said sheave head and said free end of said jib so as to selectively fix a particular selected pivot position of said sheave head relative to said jib about said adjustment axis, wherein said locking device comprises a hydraulic clamping device including a clamping cylinder and a pressure piston arranged in a chamber of said clamping cylinder, and wherein said chamber of said clamping cylinder is selectively pressurized with a hydraulic fluid so as to remotely hydraulically actuate said hydraulic clamping device.

11. The pipe-laying vehicle according to claim 10, wherein said locking device comprises a locking plate connected to and projecting laterally from said free end of said jib perpendicularly to said adjustment axis, a pivot plate connected to and projecting laterally from said sheave head perpendicularly to said adjustment axis and parallel to and spaced apart from said locking plate, a layer of a friction material received between said locking plate and said pivot plate, and said hydraulic clamping device, which selectively clamps together said locking plate and said pivot plate with said layer of said friction material therebetween in a clamping direction parallel to said adjustment axis so as to selectively hydraulically and frictionally fix said pivot plate to said locking plate and therewith selectively hydraulically and frictionally fix said sheave head to said free end of said jib so as to selectively prevent pivoting of said sheave head relative to said free end of said jib about said adjustment axis.

12. The pipe-laying vehicle according to claim 11, wherein said hydraulic clamping device further comprises a clamping bolt extending parallel to said adjustment axis through a fitting hole with play in one of said locking plate and said pivot plate and through an arcuate elongated slot in another of said locking plate and said pivot plate, and wherein said hydraulic clamping device is fitted and secured onto one end of said clamping bolt.

* * * * *